US006182315B1

(12) United States Patent
Lee

(10) Patent No.: US 6,182,315 B1
(45) Date of Patent: Feb. 6, 2001

(54) STRUCTURE OF THREE-LAYER VENTING MATTRESS

(75) Inventor: Cheng Long Lee, Taipei Hsien (TW)

(73) Assignee: Seven States Enterprise Co., Ltd., Taipei Hsien (TW)

( * ) Notice: Under 35 U.S.C. 154(b), the term of this patent shall be extended for 0 days.

(21) Appl. No.: 09/222,889

(22) Filed: Dec. 30, 1998

(51) Int. Cl.[7] ..... A47C 17/00
(52) U.S. Cl. ..... 5/690; 5/704; 5/652.1
(58) Field of Search ..... 5/590, 704, 719, 5/724, 652.1, 652.2, 725, 726, 952; 297/180.1, 219.1, 250.1, 352; 428/37, 53, 111, 171, 190, 193, 293.1

(56) References Cited

U.S. PATENT DOCUMENTS

Re. 25,868 * 9/1965 Stone et al. ..... 5/652.1 X
1,541,212 * 6/1925 Harley ..... 5/652.1 X
3,372,406 * 3/1968 Heckethorn ..... 5/652.1 X
3,451,074 * 6/1969 Crane et al. ..... 5/652.1 X

* cited by examiner

*Primary Examiner*—Terry Lee Melius
*Assistant Examiner*—Fredrick Conley
(74) *Attorney, Agent, or Firm*—Dougherty & Troxell

(57) ABSTRACT

A 3-layer venting mattress structure comprised of a steel fiber layer sandwiched by net layers sewn on its periphery. Both upper and lower net layers are made of fiber or non-woven with interlaced mesh for venting purposes. The steel layer between the fiber layers is made of high-strength steel yarn lop-sided woven in a spiral and continuous fashion to provide a mattress that allows excellent air permeability and tensile strength with sufficient capability to withstand local area loads. Therefore, the present invention solves the poor ventilation problem of the prior art, achieves the evenly distributed load susceptibility of the mattress, and provides an innovative type of space arrangement.

2 Claims, 4 Drawing Sheets

STRUCTURE OF THREE-LAYER VENTING MATTRESS

BACKGROUND OF THE INVENTION (1) Field of the Invention

The present invention relates to a structure of a 3-layer venting mattress, and more particularly to a structure of a mattress that allows excellent air permeability and evenly distributed load susceptibility.

(2) Description of the Prior Art

The prior art generally relates to a seat cushion or bed mattress which is stuffed with sponge or other similar material to improve its comfort and is popularly available in the market; however, it gives poor air permeability and the heat cannot be easily dissipated; the user either sitting or lying on the mattress for a while feels uncomfortable about the accumulated heat inside the mattress and may get sweating on the part of the body contacting the mattress. Furthermore, the residual sweat in the mattress is vulnerable to cause sediments, mold, and odor to the affected part, resulting in hygienic problem and shorter service life of the mattress. For a chronic patient, such hygienic problem could even get more direct and serious since the attached sweat and sediment due to the poor air permeability of the mattress can easily attract the growth of bacteria and cause hazard to the patient, and in case of a patient with injury, the contact of the sweat by the wound may well cause infection. It becomes obvious that the air permeability of a mattress significantly affects the user in both comfort and health concerns.

To solve the problem of heat dissipation, a bamboo mat or a mattress woven with granules is used, but at the cost of comfort in the absence of proper softness. Either the prior art mattress, a mat or a mattress woven with granules is found defective for lacking in comfort or venting function.

SUMMARY OF THE INVENTION

The primary objective of the present invention is to provide a structure of a 3-layer venting mattress which is comprised of a steel fiber layer sewn in its periphery and sandwiched by upper and lower net layers to give improved comfort and excellent air permeability.

Another objective of the present invention is to provide a structure of a 3-layer venting mattress comprised of a steel fiber layer sandwiched by upper and lower net layers, that is capable of withstanding the load under the local area where the mattress contacts the body of the user to insure that the structure of the mattress will not be easily damaged under pressure while offering proper softness for practical purpose.

Another purpose yet of the present invention is to provide a structure of a 3-layer venting mattress comprised of a steel fiber layer sandwiched by upper and lower net layers with excellent air permeability that allows a direct solution to the hygienic problem of the user and a longer service life of the mattress which is less vulnerable to the contamination by the sweats of the user due to good venting.

DETAILED DESCRIPTION OF THE INVENTION

Figure 1:
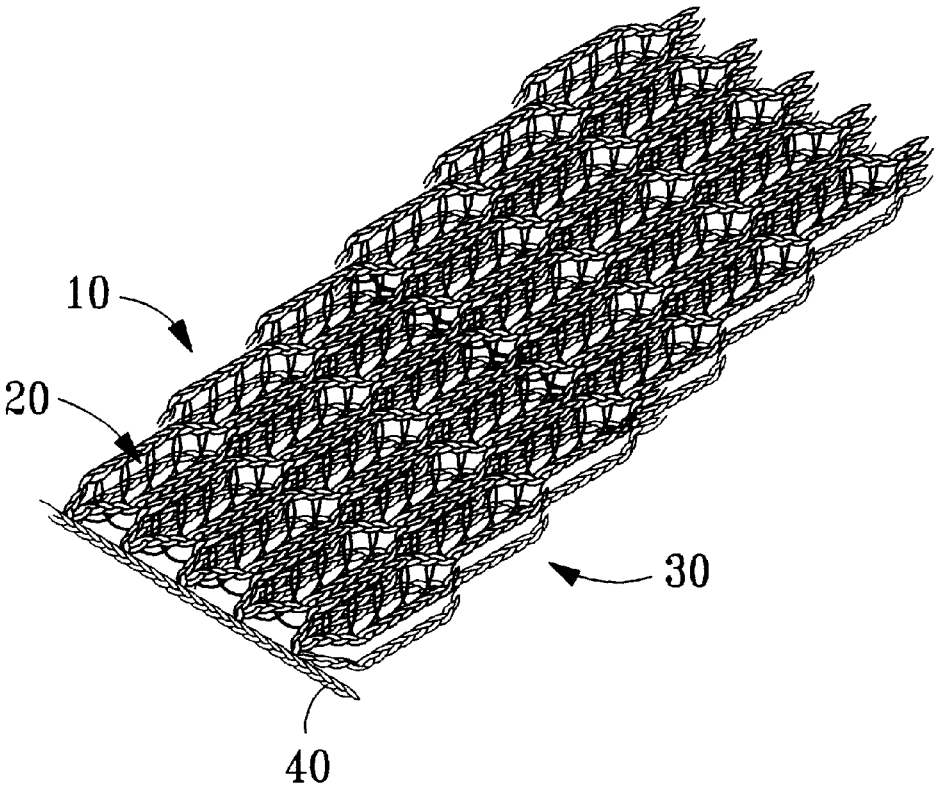
FIG. 1 is a partial perspective schematic view of the present invention.
Figure 2:
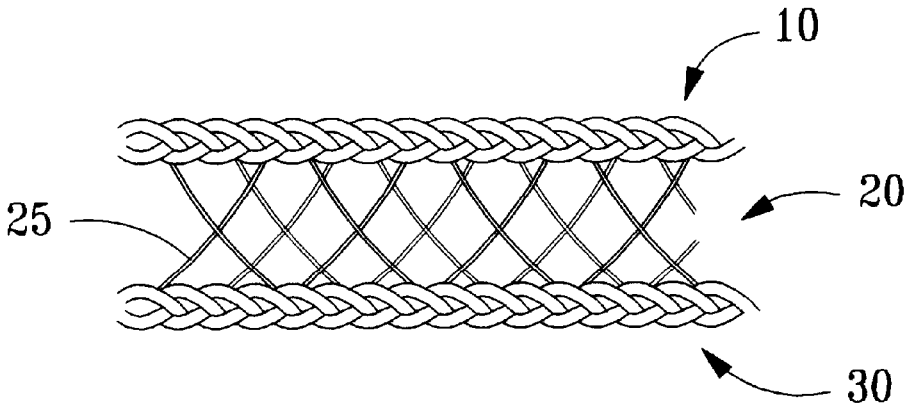
FIG. 2 is a partial side view of the present invention.

Referring to FIG. 1 and FIG. 2, the present invention is a structure of a 3-layer venting mattress comprised of an upper net layer 10, a steel fiber layer 20 and a lower net layer 30 sewn together with thread 40 in periphery of the mattress; said upper layer 10 and lower layer 30 are made of fiber or non-woven, the surface of each of said upper layer 10 and lower layer 30 is interlaced mesh to allow air permeation; the steel fiber layer 20, woven in spiral, continuous and lop-sided pattern using high-strength steel yarn 25 is sandwiched between said upper layer 10 and lower layer 30 for the mattress to offer excellent air permeability.

Said steel fiber layer 20 is made of high-strength steel fiber 25 to give the mattress a firm and solid structure with sufficient capability to withstand the load on local areas, so that the structure of the mattress will not be damaged due to the pressure caused by the user sitting or lying down on it while the heat generated from the long-term contact between the mattress and the user can be well dissipated; furthermore, the softness of the mattress can be adjusted depending on the amount of said high-strength steel yarn 25 to meet the needs of each individual application.

Figure 3:
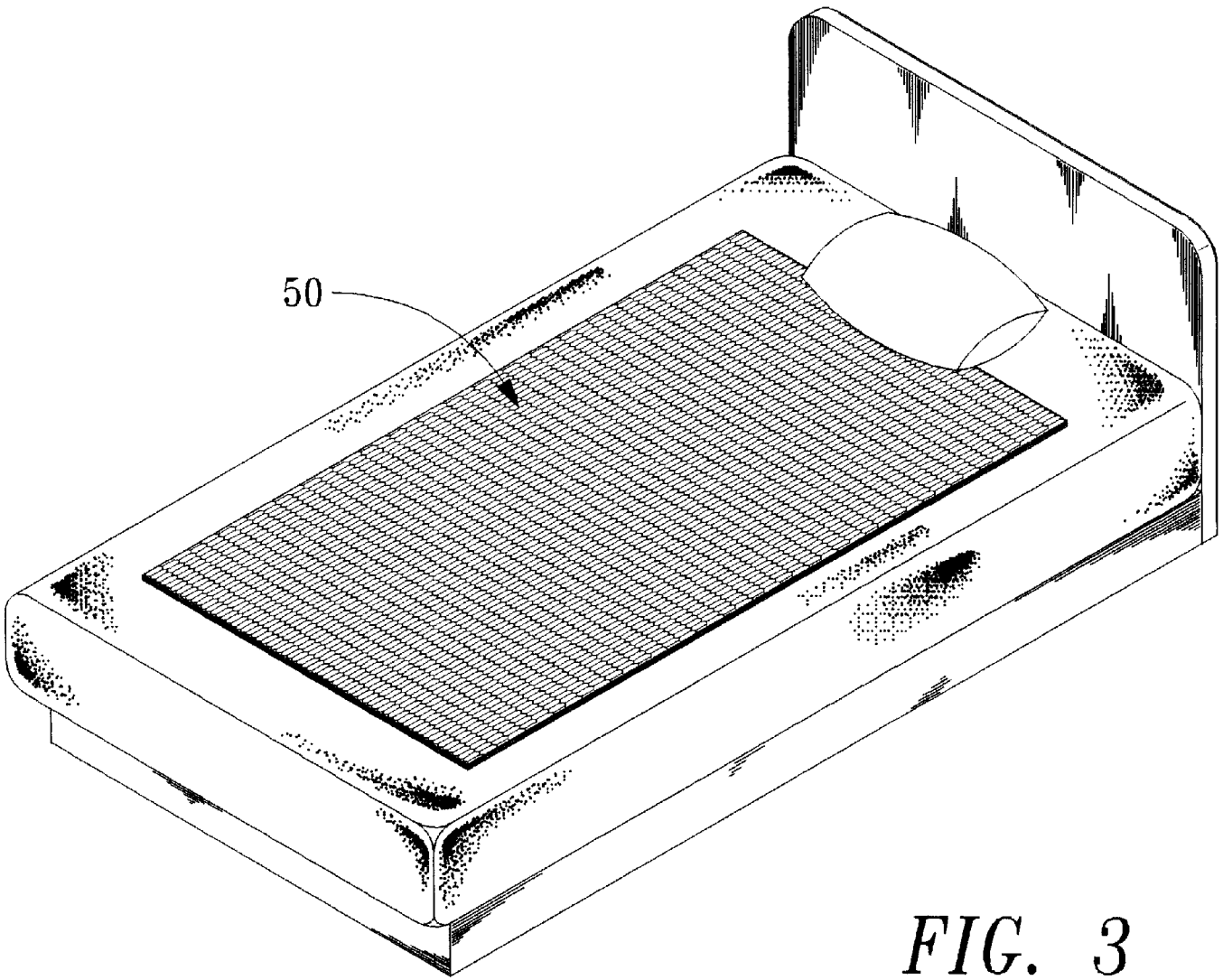
FIG. 3 is a perspective view of the first preferred embodiment of the present invention.
Figure 4:
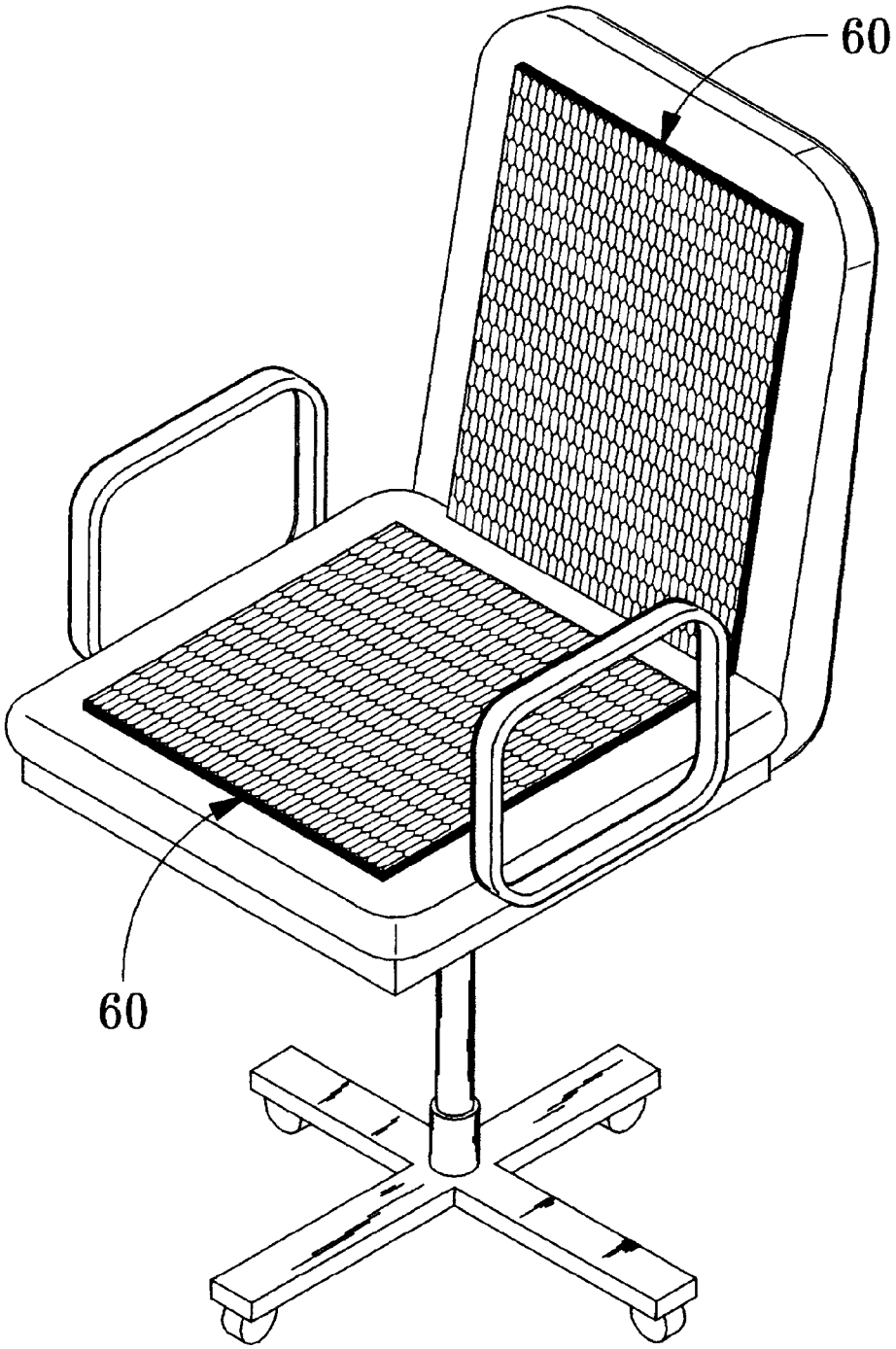
FIG. 4 is a perspective view of the second preferred embodiment of the present invention.

The areas to apply the present invention is highly comprehensive. Referring to FIG. 3 and FIG. 4, two preferred embodiments of the present invention are illustrated. FIG. 3 shows a mattress of the first preferred embodiment, wherein the main portion of a mattress 50 for the bed utilizes the structure of a 3-layer venting mattress. When lying on the mattress 50, the user will not sweat from long-term contact with the mattress 50 due to its excellent air permeability; consequently the user feels very comfortable and enjoys a better quality of sleeping. FIG. 4 shows a cushion 60 of the second embodiment of the present invention placed on a chair in an office or at home, or on a seat in a car; and the continuous use of the cushion 60 allows comfort while improving the personal hygiene and helping maintain the cushion 60 in clean condition due to the outstanding capabilities of air venting and heat dissipation.

Figure 5A:
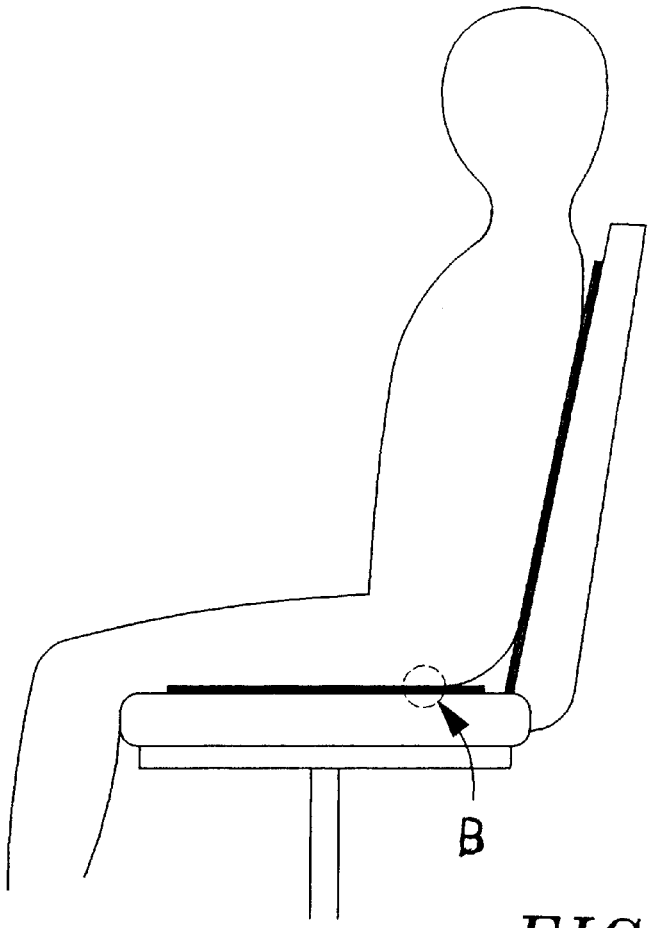
FIG. 5A is a schematic side view of the present invention used as a seat cushion.
Figure 5B:
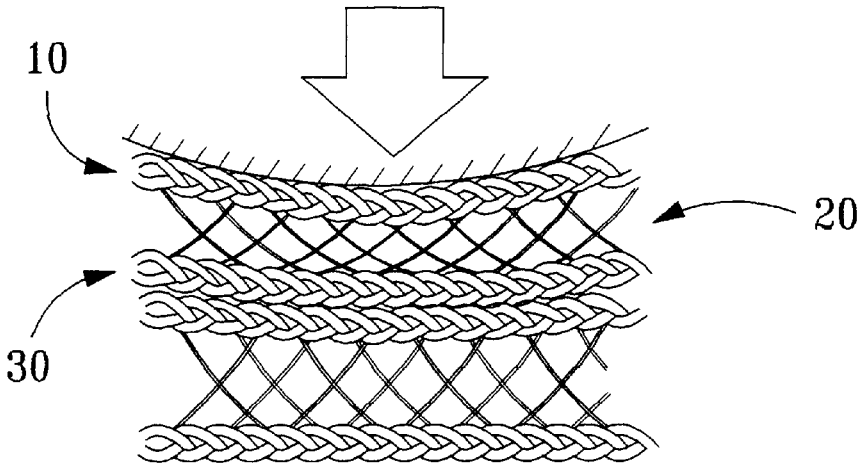
FIG. 5B is an enlarged view of area B in FIG. 5A.

Now referring to FIGS. 5A and 5B showing the present invention put under pressure; the steel fiber layer 20 made of high-strength steel yarn 25 intensively woven in the spiral, continuous and lop-sided pattern improves the structure of the mattress 50 to yield sufficient loading ability of local area when the mattress 50 is under pressure without damaging its structure while preserving the venting and heat dissipation features to be expected from the mattress.

In addition, depending on the purpose of the application, more than one 3-layer venting mattress 50 can be overlapped to allow more flexible applicability of the present invention.

When compared to the prior art of the mattress, the present invention provides the following advantages:

1. The application of the present invention achieves better air permeability and comfort;
2. The application of the present invention offers a sufficient loading capability of local area under pressure caused by the contact with the user without damaging the structure of the present invention;
3. The application of the present invention helps reduce the sweat from the user to offer a direct solution of personal hygienic problem while improving the service life of the present invention;
4. The structure of the present invention can be used for the production of cushion for chair, mattress for bed and other similar mattresses.

What is claimed is:

1. A multi-layer, ventilating cushion material comprising:

a) a first layer of steel fiber formed in a continuous spiral, the first layer having upper and lower portions;

b) an upper layer of mesh fiber material having pores to facilitate air circulation therethrough, the upper layer being interlaced with the upper portion of the first layer; and, c) a lower layer of mesh fiber material having pores to facilitate air circulation therethrough, the lower layer being interlaced with the lower portion of the first layer.

2. The multi-layer, ventilating cushion material as in claim 1, wherein the steel fiber comprises a high strength steel yarn.

* * * * *